US005138921A

United States Patent [19]

Winckler

[11] Patent Number: 5,138,921

[45] Date of Patent: Aug. 18, 1992

[54] DEVICE FOR CUTTING AND/OR SLITTING A TRAVELLING SHEET OR WEB OF MATERIAL TO FORM BOX-TYPE PACKAGES

[75] Inventor: Gerhard Winckler, Hamburg, Fed. Rep. of Germany

[73] Assignee: Peters Maschinenfabrik GmbH, Hamburg, Fed. Rep. of Germany

[21] Appl. No.: 717,666

[22] Filed: Jun. 19, 1991

[30] Foreign Application Priority Data

Jun. 28, 1990 [CH] Switzerland ..... 02165/90

[51] Int. Cl.[5] ..... B26D 1/24

[52] U.S. Cl. ..... 83/501; 83/498; 83/676; 83/425.4

[58] Field of Search ..... 83/425.4, 498, 499, 83/501, 502, 675, 678

[56] References Cited

U.S. PATENT DOCUMENTS 2,236,366 3/1941 Chapman et al. ..... 83/501 X
3,929,047 12/1975 Brandl ..... 83/501 X
3,951,024 4/1976 Weiskopf ..... 83/501 X
3,977,285 8/1976 Perztsch et al. ..... 83/501

FOREIGN PATENT DOCUMENTS 2326556 12/1974 Fed. Rep. of Germany .
3907736C1 5/1990 Fed. Rep. of Germany .

*Primary Examiner*—Hien H. Phan
*Assistant Examiner*—Raymond D. Woods
*Attorney, Agent, or Firm*—Hill, Van Santen, Steadman & Simpson

[57] ABSTRACT

A device for cutting and/or slitting travelling webs or sheet-like board material includes a pair of coacting rotary circular knives mounted on each side of the path of the web with the two peripheral cutting edges being in contact with one another. The device includes the use of a flat spring to provide an arrangement for biasing one knife against the other knife in the axial direction to provide the desired elastic pretension therebetween.

8 Claims, 2 Drawing Sheets

DEVICE FOR CUTTING AND/OR SLITTING A TRAVELLING SHEET OR WEB OF MATERIAL TO FORM BOX-TYPE PACKAGES

BACKGROUND OF THE INVENTION

The present invention concerns a device for cutting and/or slitting a travelling web or sheet-like material to form a blank for a box-type package, which device includes a frame supporting two crosswise rotating shafts situated on either side of the path of the travelling web, a pair of rotary circular knives, each provided with a sliding sleeve for positioning the knives on the shaft as a pair of coacting knives, and means for axially pressing the knives together with a desired axial pretension.

The device is generally used in a lengthwise creasing and slitting machine. For an easy understanding of the operation of such a machine, reference is made to FIG. 1 of the attached drawings, wherein a web or sheet B, for instance of corrugated board, is travelling through in a flat plane which extends basically perpendicular to the plane of the Figure. The machine or device is equipped with a pair of circular rotary tools, such as circular rotary knives 1 and 1', which are constructed to cut the web B lengthwise, i.e., in the travelling direction. The knives 1 and 1' cut the web B in a way similar to the action of scissors, which is to say that the cutting is achieved by means of the two peripheral edges 1*a* and 1'*a* of the knives 1 and 1', respectively. To this aim, each of the edges 1*a* and 1'*a* are bevelled and are axially pressed together under the effect of an elastic pretension by means for axially pressing. Both the knives 1 and 1' are mounted on their own rotary shafts 10 and 10', respectively, so as to be positioned with the knife 1, as illustrated below the web B, and the knife 1' above the web B. For the crosswise positioning of the lengthwise cutting action, the prior art devices had each knife 1 and 1' mounted on shiftable hollow sleeves 2 and 2', respectively, which allow the setting in the desired axial position. The shifting means consist generally of a suitable fork, which is not illustrated, which engages the sleeves 2 and 2'. As a rule, several slitting tools were provided on the two shafts 10 and 10'. Due to the lengthwise shifting, the sleeves 2 and 2' on the shafts 10 and 10', there is possibility to put the two edges 1*a* and 1'*a* of the tool pairs 1 and 1' into contact with or set apart from one another.

To achieve the above-mentioned elastic pretension with the two rotary knives, the prior art specified that one of the two knives be arranged on a ring 3, which itself is fitted with a slight axial clearance with regard to the sleeve. Moreover, several spiral springs were arranged circularly and intercalated between the sleeve and the ring to form the means for elastic pretensioning, with the two knives placed one against the other in the operation position. However, the circular, non-continuous arrangement of the springs around the knife has a drawback of causing a rather erratic, for example jerky, operation of the knife pair when rotating.

SUMMARY OF THE INVENTION

The present invention has the purpose to eliminate the above-mentioned drawback and to provide a design of a machine with knives rotating without tossing or a jerky motion.

To accomplish these goals, the present invention is directed to an improvement in a device for cutting and/or slitting of a travelling web or sheet-like material to produce blanks for box-type packages, said device comprising two spaced apart rotary shafts situated on either side of a path of a travelling web and extending transverse to the direction of movement of the web, a pair of rotary circular knives, each knife having a sliding sleeve for holding the knife and for axially positioning each knife on its respective shaft, with the peripheral cutting edges being in an operating position and means to axially press the circular knives against one another according to an elastic pretension. The improvements are that the means for axially pressing includes at least one elastic circular flat spring being interposed between a knife and its respective sleeve.

Other advantages and features of the invention will be readily apparent from the following description of the preferred embodiments, the drawings and claims.

DESCRIPTION OF THE PREFERRED EMBODIMENTS

Figure 1:
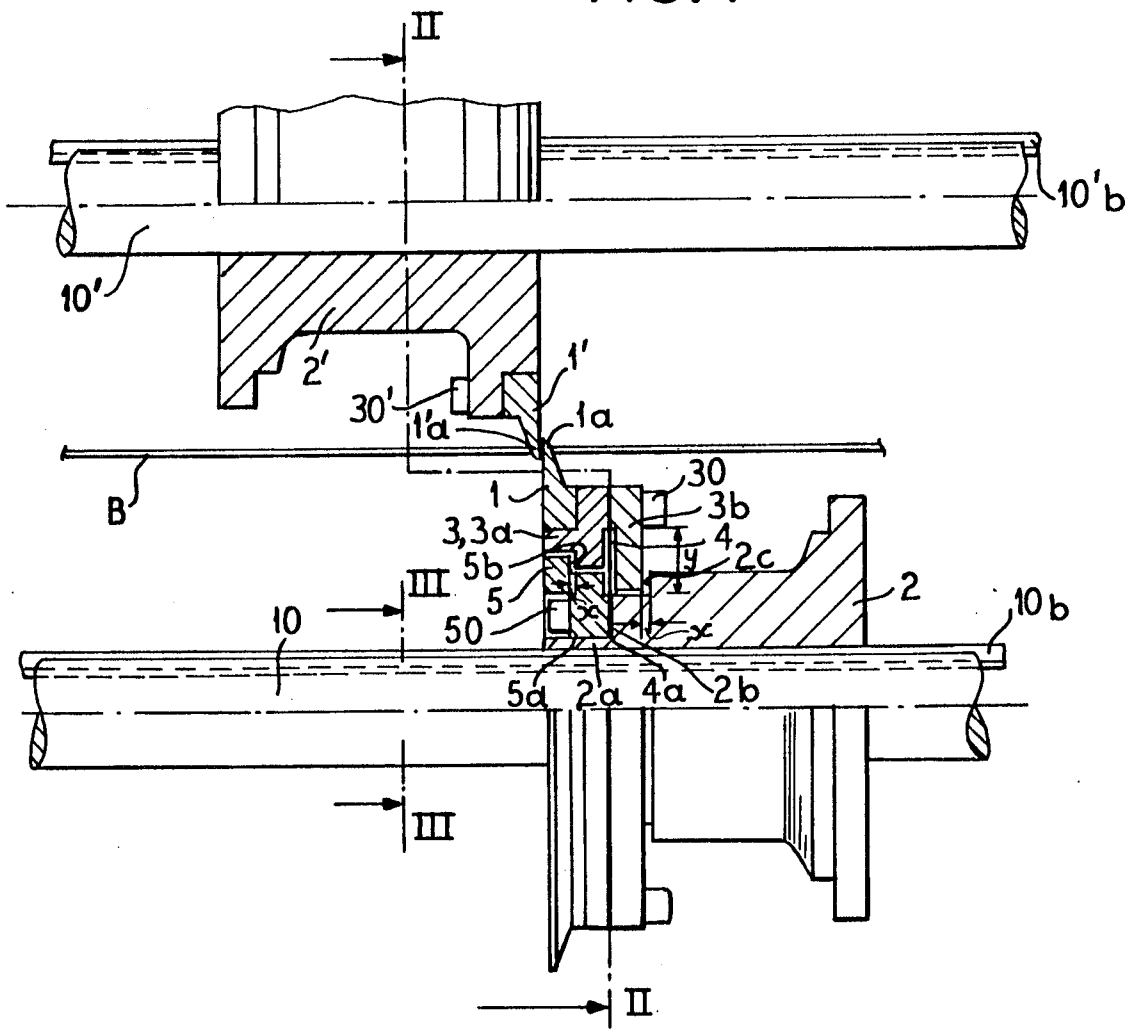
FIG. 1 is a partial cross sectional view of a pair of cutting and/or slitting tools in accordance with the present invention.

The principles of the present invention are particularly useful in a cutting and/or slitting device, which includes a pair of shafts 10 and 10' mounted in a frame to be on either side of a path of a web B moving through the device. As illustrated, the shafts 10 and 10' have sleeves 2 and 2', which support the circular tools illustrated as circular knives 1 and 1', respectively. As illustrated, the circular tool or knife 1' is mounted directly on the sleeve 2' by means of threaded fasteners 30'. The knife 1 is mounted directly on a ring 3, which is connected to the sleeve 2 by means of a membrane or circular flat spring 4, which is centered on the axis of the shaft 10. The ring 3 is divided into two annular parts 3*a* and 3*b*, which are situated on either side of the flat spring 4 and grip it, or, in other words, sandwich it therebetween. Several annularly-arranged screws or threaded fasteners 30 keep the knife 1 and the two annular parts 3*a* and 3*b* and the flat spring 4 together so as to make up a circular, compact assembly centered on the shaft 10. The sleeve 2 has an axial extension 2*a* extending from a shoulder 2*b*. The flat spring 4 is provided with a central bore 4*a*, which receives the axial extension 2*a* of the sleeve 2. A second ring 5 is provided with a central bore 5*a* and is also telescopically received on the axial extension 2*a* of the sleeve 2 so that the flat spring 4 is sandwiched between the ring 5 and the shoulder 2*b*. A plurality of screws 50 hold the ring, the spring and sleeve 2 together in a fixed arrangement.

The sleeve 2 also has a second shoulder 2*c* axially spaced from the shoulder 2*b* and the ring 5 has an annular shoulder 5*b* axially spaced from the surface of the ring 5 engaging the spring 4. The spacing between the shoulder 5*b* and the shoulder 2*c* is such that the assembly formed by the ring components 3*a* and 3*b* will have, as illustrated, an axial clearance x between a surface of the components 3*a* and the shoulder 5*b*, as well as between the shoulder 2*c* and the component 3*b*. This clearance enables the components to be shifted appropriately, one with respect to the other, in the axial direction. The elasticity of the flat spring 4 depends on its structure, its shape, its thickness, as well as its free radial length y. As illustrated, the shoulder 2*c* will arrest and limit the assembly's movement relative to the sleeve 2 when the part 3*b* engages the shoulder 2*c*. The shoulder 5*b* will act to arrest the assembly's movement to the left when it is engaged by a portion of the annular part 3*a*. It should be noted that the right-hand shoulder 2*c* is important, since, for safety reasons, it is to limit the shift of the flat spring from the operating position when the lower knife 1 is held under elastic load against the upper life 1', which is in a fixed axial position. This means that the upper knife 1' is to be fitted directly by means of the annularly-arranged screws 30' on the sleeve 2', which itself is locked in the axial position according to the prior art method, which will be discussed hereinafter. In this way, the upper knife 1 is able to determine the crosswise position of the slitting and/or cutting action.

The continued and regular, though not punctual, arrangement of the flat spring 4 all over the circular periphery of the knife 1 will bring about a constant and identical amplitude of the operating pretension between the two knives 1 and 1', which will, thus, be able to rotate in a regular and jerk-free fashion.

Figure 2:
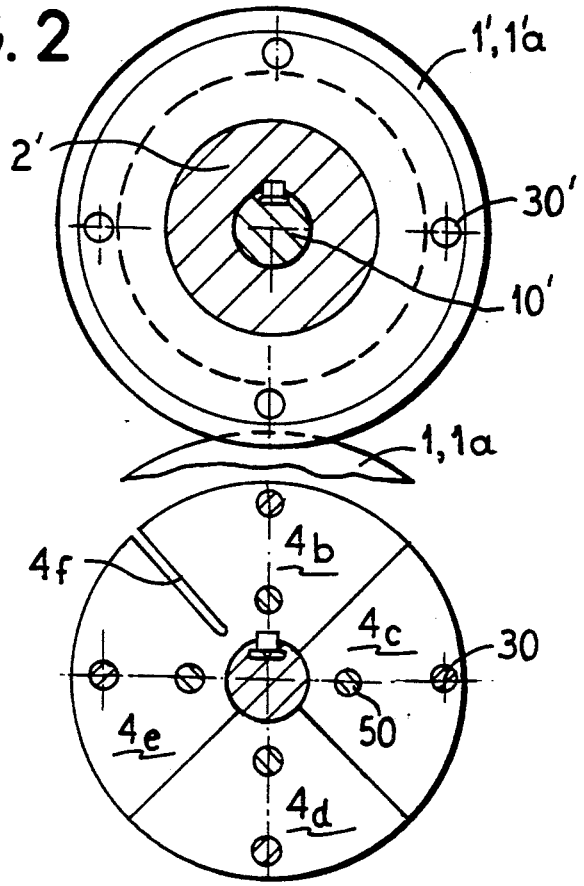
FIG. 2 is a cross sectional view taken along the lines II—II of FIG. 1.

Instead of using a flat spring 4, it is also possible to use several circular sectors 4*b*–4*e*, which are circularly contiguous, as illustrated in FIG. 2. As illustrated in the Figures, such as FIG. 2, both the knives 1 and 1' have a continuous circular configuration to continuously cut a web passing therethrough. However, if it is desired to only cut certain portions of the web during each rotation of the shafts 10 and 10', the knife, as well as the flat spring 4, can consist either of a single circular sector, for example 4*b*, or at least two circular sectors, for example 4*b* and 4*d*, which are arranged on the circle and are spaced by non-knife portions 4*c* and 4*e*. In such an arrangement, the knives would cut while the sector, such as 4*b*, was engaging the web, but then when the knife moved into the area of the sector 4*c*, no cutting would occur until the next sector 4*d* arrived.

Figure 4:
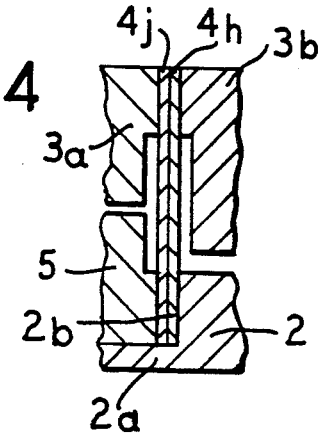
FIG. 4 is an enlarged partial cross sectional view with portions broken away and removed for purposes of illustration of an embodiment of the flat spring.

As illustrated in FIG. 2, two adjacent sectors, such as 4*e* and 4*d*, may also be separated from one another only by a radial slot 4*f*, which will extend from the outer periphery of the flat spring 4. A flat spring 4 may, moreover, consist of several superimposed flat springs for appropriate application of the elasticity. In other words, the spring 4 may be composed of several layers of springs 4*b*, 4; (see FIG. 4).

Figure 3:
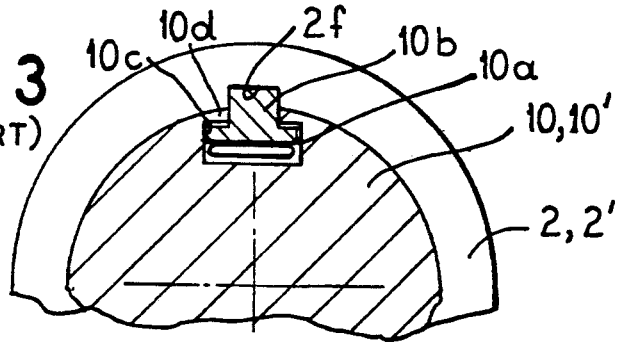
FIG. 3 (PRIOR ART)
FIG. 3 is a partial cross sectional view taken along the lines III—III of FIG. 1.

Each of the sleeves 2 and 2' are locked on their respective shaft by a prior art arrangement, which is best illustrated in FIG. 3. As illustrated, the shaft 10 is provided with an axially extending passage 10*c*, which has a pair of overhangs 10*d*. The passage receives an expandable device 10*a* and a cotter 10*b*, which has a portion extending between the two overhangs 10*d*. When pressure is applied to the expandable device 10*a*, it forces the cotter 10*b* radially outward so that it will engage the sleeves, such as 2, with a frictional force insuring the axial position of the knife. As illustrated, the cotter is received in a groove 2*f* of the sleeve 2 and, thus, functions to insure the rotary connection between the sleeve 2 and the shaft 10. The shaft 10' also has a similar arrangement including a cotter 10'*b* for positioning each of the sleeves 2' and the respective 1'.

As already mentioned, the device described above is generally used in a creasing and/or slitting machine for producing package blanks and is likely to be equipped with several pairs of creasing tools on the shafts 10 and 10'. Since the present invention is directed solely to the improvement in the means for axially pressing, the creasing tools have not been illustrated.

Although various minor modifications may be suggested by those versed in the art, it should be understood that I wish to embody within the scope of the patent granted hereon all such modifications as reasonably and properly come within the scope of my contribution to the art.

I claim:

1. In a device for cutting and/or slitting of a travelling web or sheet-like material to form blanks for box-type packages, said device including a frame having two crosswise rotary shafts situated on either side of a path for the travelling web, a pair of rotary circular knives, a pair of sliding sleeves, said knives being mounted on said sleeves, means for holding each sleeve and the respective knife in the desired axial position on the respective shaft, and means for axially pressing one knife against the other knife to a desired elastic pretension, the improvements comprising said means for axially pressing comprising an elastic circular flat spring being positioned between said one knife and a respective one sleeve, said one knife being mounted on a first ring which, in turn, is slidably received on said one sleeve, said first ring consisting of two annular parts situated on opposite sides of said flat spring and engaging an outer peripheral portion of said spring, a second inner annular part of the flat spring being sandwiched between a shoulder of the one sleeve and a fastening ring mounted on said one sleeve, said flat spring having a third annular part between the first and second annular parts having a radial length which determines the degree of elasticity of the amplitude of the flat spring and the elastic pretension thereof.

2. In a device according to claim 1, wherein the flat spring consists of at least two contiguous circular sectors.

3. In a device according to claim 2, which has means for axially arresting movement of the two annular parts of the first ring to limit axial shifting of the flat spring.

4. In a device according to claim 3, wherein the flat spring is composed of several superimposed flat springs.

5. In a device according to claim 3, wherein the flat spring is provided with a radial slot.

6. In a device according to claim 1, which includes means for arresting movement of an outer peripheral portion of the spring to limit an axial shifting of the spring and knife.

7. In a device according to claim 1, wherein the flat spring is composed of several superimposed flat springs.

8. In a device according to claim 1, wherein the flat spring is provided with a radial slot.

* * * * *